US005475285A

United States Patent [19]

Konopka

[11] Patent Number: 5,475,285

[45] Date of Patent: Dec. 12, 1995

[54] LAMP CIRCUIT LIMITED TO A BOOSTER IN WHICH THE POWER OUTPUT DECREASES WITH INCREASING FREQUENCY

[75] Inventor: John G. Konopka, Barrington, Ill.

[73] Assignee: Motorola, Inc., Schaumburg, Ill.

[21] Appl. No.: 268,346

[22] Filed: Jun. 29, 1994

Related U.S. Application Data

[63] Continuation of Ser. No. 916,234, Jul. 17, 1992, abandoned.

[51] Int. Cl.[6] ..... H05B 37/02

[52] U.S. Cl. ..... 315/224; 315/308; 315/247; 315/219; 315/DIG. 7; 315/DIG. 4; 315/DIG. 5

[58] Field of Search ..... 315/247, 307, 315/291, 308, DIG. 4, DIG. 5, DIG. 7, 209 R, 219, 223, 224, 247

[56] References Cited

U.S. PATENT DOCUMENTS

| | | | |
|---|---|---|---|
| 4,949,016 | 8/1990 | De Bijl et al. | 315/224 |
| 5,049,790 | 9/1991 | Herfurth et al. | 315/224 |
| 5,107,184 | 4/1992 | Hu et al. | 315/DIG. 4 |
| 5,140,229 | 8/1992 | Yagi et al. | 315/224 |
| 5,142,203 | 8/1992 | Oda et al. | 315/DIG. 7 |
| 5,144,195 | 9/1992 | Konopka et al. | 315/94 |
| 5,185,560 | 2/1993 | Nilssen | 315/DIG. 7 |
| 5,293,099 | 3/1994 | Bobel | 315/DIG. 7 |

FOREIGN PATENT DOCUMENTS

| | | | |
|---|---|---|---|
| 0059053 | 1/1982 | European Pat. Off. | 315/247 |

*Primary Examiner*—Robert J. Pascal
*Assistant Examiner*—Michael Shingleton
*Attorney, Agent, or Firm*—J. Ray Wood

[57] ABSTRACT

A power supply circuit (100) for use in driving fluorescent lamps (102, 104, 106) has a current mode control voltage boost IC (144) which produces a boosted voltage and has a power control input (pin 3) and a frequency control input (pin 4). The lamps are driven by a self oscillating inverter (178, 180, 196, 198) which is powered from the voltage boost IC and which operates at a frequency independent therefrom. In order to dim the lamps a D.C. bias voltage is applied to the power control input. At the same time a commensurate D.C. bias voltage is applied to the frequency control input so as to provide power factor correction in dependence on the power produced by the voltage boost IC. The circuit thus provides a substantially constant, optimum power factor at both full and dimmed light levels.

15 Claims, 2 Drawing Sheets

LAMP CIRCUIT LIMITED TO A BOOSTER IN WHICH THE POWER OUTPUT DECREASES WITH INCREASING FREQUENCY

This is a continuation of application Ser. No. 07/916,234, filed Jul. 17, 1992 and now abandoned.

FIELD OF THE INVENTION

This invention relates to power supply circuits, and particularly, though not exclusively, to power supply circuits for use in driving gas discharge lamp loads.

BACKGROUND OF THE INVENTION

In circuits for driving gas discharge lamp loads, such as fluorescent lamps, it is known to reduce the power from which the lamps are driven (so as to produce dimming of the lamps) by using a resonant inductor and capacitor in series with the lamps and by varying the circuit's operating frequency. In such a known circuit, when the operating frequency of the circuit is changed, current through the lamps is reduced and the lamps are correspondingly dimmed.

However, employing variation of the circuit's operating frequency in order to produce dimming renders the actual dimming level of the circuit susceptible to changes in the circuit's temperature which cause the circuit's operating frequency to change.

SUMMARY OF THE INVENTION

In accordance with the invention there is provided a power supply circuit, the circuit comprising:

input means for receiving an input voltage;

voltage boost means coupled to the input means for producing a boosted voltage, the voltage boost means having a power control input and a frequency control input;

power control means coupled to the power control input of the voltage boost means for controlling the power produced thereby; and frequency control means coupled to the frequency control input of the voltage boost means for controlling the frequency of operation thereof in dependence on the power produced by the voltage boost means so as to provide power factor correction in dependence on the power produced by the voltage boost means.

In such a power supply circuit, by controlling the frequency of operation of the voltage boost means in dependence on the power produced thereby, variation in the circuit's power factor is corrected as its output power varies.

Thus, for example, in a preferred embodiment the power supply circuit drives a gas discharge lamp load through an inverter-oscillator which operates at a frequency independent of that of the voltage boost means. This ensures that the driving circuit's power factor remains constant as the dimming level of the lamps is varied, and that variation of the circuit's temperature does not substantially affect the dimming level of the lamps.

BRIEF DESCRIPTION OF THE DRAWINGS

One fluorescent lamp driver circuit incorporating a power supply circuit in accordance with the present invention will now be described, by way of example only, with reference to the accompanying drawings, in which.

DESCRIPTION OF THE PREFERRED EMBODIMENT

Figure 1:
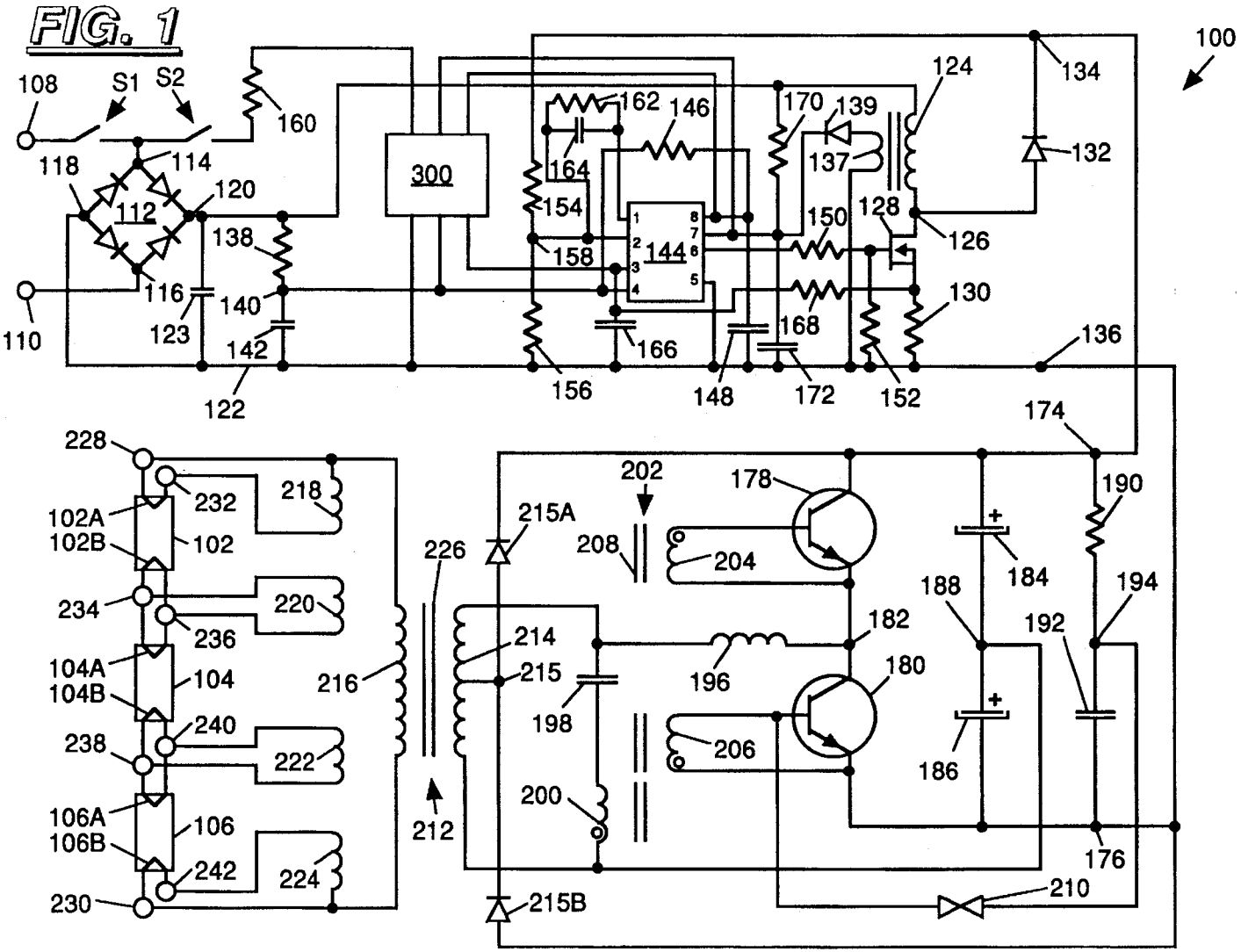
FIG. 1 shows a schematic circuit diagram of a driver circuit for driving three fluorescent lamps.

Referring now to FIG. 1, a circuit 100, for driving three fluorescent lamps 102, 104, 106, has two input terminals 108, 110 for receiving thereacross an AC supply voltage of approximately 277 V at a frequency of 60 Hz. A full-wave rectifying bridge circuit 112 has two input nodes 114, 116 and has two output nodes 118, 120. The input node 114 is connected to the input terminal 108 via a conventional two-pole, single throw "ON-OFF" switch S1 having an element (not shown) which is mechanically movable between "open" and "closed" positions. The input node 116 is connected directly to the input terminal 110. The output node 118 of the bridge 112 is connected to a ground voltage rail 122. A capacitor 123 (having a value of approximately 0.18 μF) is connected between the output nodes 118 and 120 of the bridge circuit 112.

A cored inductor 124 (having an inductance of approximately 4.5 mH) has one end connected to the output node 120 of the bridge 112, and has its other end connected to a node 126. A field effect transistor (FET) 128 (of the type BUZ90) has its drain electrode connected to the node 126. The field effect transistor (FET) 128 has its source electrode connected, via a resistor 130 (having a value of approximately 1.6 Ω), to the ground voltage rail 122. A diode 132 (of the type MUR160) has its anode connected to the node 126 and has its cathode connected to an output node 134. The ground voltage rail 122 is connected to an output node 136.

A resistor 138 (having a resistance of approximately 2MΩ) is connected between the output node 120 of the bridge 112 and a node 140. A capacitor 142 (having a capacitance of approximately 0.0039 μF) is connected between the node 140 and the ground voltage rail 122. A current-mode control integrated circuit (IC) 144 (of the type AS3845, available from ASTEC Semiconductor) has its $R_T/C_T$ input (pin 4) connected to the node 140. The current mode control IC 144 has its $V_{REG}$ output (pin 8) connected, via a resistor 146 (having a resistance of approximately 10KΩ), to the node 140 and connected, via a capacitor 148 (having a capacitance of approximately 0.22 μF) to the ground voltage rail 122. The current mode control IC 144 has its control signal output (pin 6) connected, via a resistor 150 (having a resistance of approximately 20 Ω), to the gate electrode of the FET 128. The gate electrode of the FET 128 is also connected, via a resistor 152 (having a resistance of approximately 22KΩ), to the ground voltage rail 122.

Two resistors 154, 156 (having respective resistances of approximately 974KΩ and 5.36KΩ) are connected in series, via an intermediate node 158, between the output terminal 134 and the ground voltage rail 122. The current mode control IC 144 has its $V_{FB}$ input (pin 2) connected to the node 158. The current mode control IC 144 has its COMP output (pin 1) connected to its $V_{FB}$ input (pin 2) via a parallel-connected resistor 162 (having a resistance of approximately 1.5MΩ) and capacitor 164 (having a capacitance of approximately 0.22 μF). The current mode control IC 144 has its current sense input (pin 3) connected to the ground voltage rail 122 via a capacitor 166 (having a capacitance of approximately 470 pF) and to the source electrode of the FET 128 via a resistor 168 (having a resistance of approximately 1KΩ).

The current mode control IC 144 has its $V_{CC}$ input (pin 7) connected to the bridge rectifier output node 120 via a resistor 170 (having a resistance of approximately 240KΩ) and connected to the ground voltage rail 122 via a capacitor 172 (having a capacitance of approximately 100 μF). The current mode control IC 144 has its GND input (pin 5) connected to the ground voltage rail 122. A winding 137, wound on the same core as the inductor 124, has one end connected to the ground voltage rail 122 and has its other end connected via a diode 139 to the $V_{CC}$ input (pin 7) of the IC 144.

The power supply output terminals 134 and 136 are connected to input nodes 174 and 176 of a half-bridge inverter formed by two npn bipolar transistor 178 and 180 (each of the type BUL45). The transistor 178 has its collector electrode connected to the input node 174, and has its emitter electrode connected to an output node 182 of the inverter. The transistor 180 has its collector electrode connected to the node 182, and has its emitter electrode connected to the input node 176. Two electrolytic capacitors 184 and 186 (each having a value of approximately 47 μF) are connected in series between the inverter input nodes 174 and 176 via an intermediate node 188. For reasons which will be explained below, a resistor 190 (having a value of approximately 2.2MΩ) and a capacitor 192 (having a value of approximately 0.1 μF) are connected in series between the inverter input nodes 174 and 176 via an intermediate node 194.

The inverter output node 182 is connected to a series-resonant tank circuit formed by an inductor 196 (having a value of approximately 5.35 mH) and a capacitor 198 (having a value of approximately 10 nF). The inductor 196 and the capacitor 198 are connected in series, via a primary winding 200 of a base-coupling transformer 202 which will be described more fully below, between the inverter output node 182 and the node 188. The base-coupling transformer 202 includes the primary winding 200 (having approximately 8 turns) and two secondary windings 204 and 206 (each having approximately 24 turns) wound on the same core 208. The secondary windings 204 and 206 are connected with opposite polarities between the base and emitter electrodes of the inverter transistors 178 and 180 respectively. The base electrode of the transistor 180 is connected via a diac 210 (having a voltage breakdown of approximately 32 V) to the node 194.

An output-coupling transformer 212 has its primary winding 214 connected in series with the inductor 196 and in parallel with the capacitor 198 and the primary winding 200 of the base-coupling transformer 202 to conduct output current from the tank circuit formed by the series-resonant inductor 196 and capacitor 198. The primary winding 214 of the transformer 212 is center-tapped at a node 215, which is coupled to the inverter input nodes 174 and 176 via diodes 215A and 215B respectively.

The output-coupling transformer 212 includes the primary winding 214 (having approximately 70 turns), a principal secondary winding 216 (having approximately 210 turns) and four filament-heating secondary windings 218, 220, 222 and 224 (each having approximately 3 turns) wound on the same core 226. The principal secondary winding 216 is connected across output terminals 228 and 230, between which the three fluorescent lamps 102, 104 and 106 are connected in series. The lamps 102, 104 and 106 each have a pair of filaments 102A & 102B, 104A & 104B and 106A & 106B respectively located at opposite ends thereof. The filament-heating secondary winding 218 is connected across the output terminal 228 and an output terminal 232, between which the filament 102A of the lamp 102 is connected. The filament-heating secondary winding 220 is connected across output terminals 234 and 236, between which both the filament 102B of the lamp 102 and the filament 104A of the lamp 104 are connected in parallel. The filament-heating secondary winding 222 is connected across output terminals 238 and 240, between which both the filament 104B of the lamp 104 and the filament 106A of the lamp 106 are connected in parallel. The filament-heating secondary winding 224 is connected across the output terminal 230 and an output terminal 242, between which the filament 106B of the lamp 106 is connected.

A second conventional two-pole, single throw switch S2, like the switch S1, having an element (not shown) which is mechanically movable between "open" and "closed" positions, is connected between the node 114 and a resistor 160 (having a value of approximately 1MΩ). As will be explained below, the switch S2 functions as a "HIGH-LOW" switch.

Figure 2:
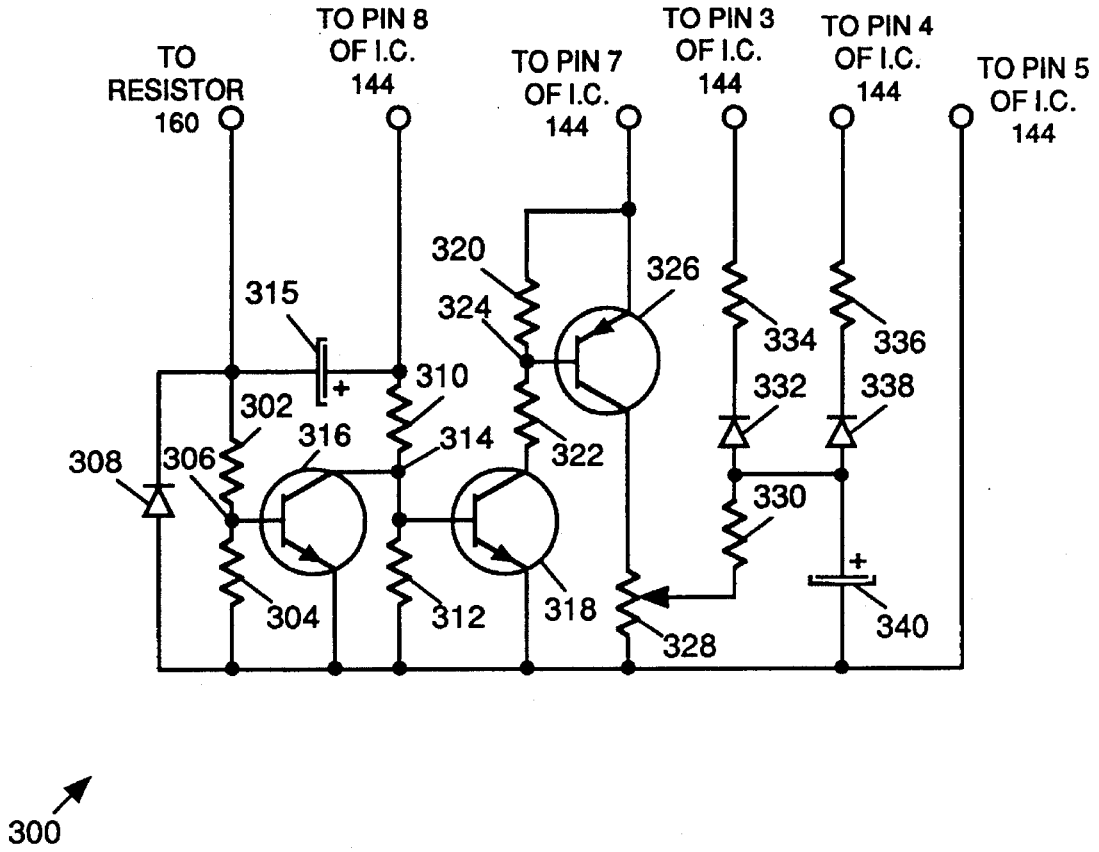
FIG. 2 shows a detailed schematic circuit diagram of a control circuit used in the driver circuit of FIG. 1.

Referring now also to FIG. 2, the driver circuit 100 also includes a control circuit 300. The control circuit 300 has a resistive divider formed by a resistor 302 (having a value of approximately 22KΩ) and a resistor 304 (having a value of approximately 47KΩ) connected in series between the resistor 160 and the ground voltage rail 122 (which is connected to pin 5 of the current mode control IC 144) via an intermediate node 306. A diode 308 has its cathode electrode connected to the resistor 160 and has its anode electrode connected to the ground voltage rail 122.

A resistive divider formed by a resistor 310 (having a value of approximately 22KΩ) and a resistor 312 (having a value of approximately 10KΩ) connected in series between pin 8 of the current mode control IC 144 and the ground voltage rail 122 via an intermediate node 314. A capacitor 315 (having a value of approximately 33 mF) is connected between pin 8 of the current mode control IC 144 and the cathode electrode of the diode 308.

An npn bipolar transistor 316 (of the type 2N3904) has its base electrode connected to the node 306, has its collector electrode connected to the node 314, and has its emitter electrode connected to the ground voltage rail 122.

A further npn bipolar transistor 318 (of the type 2N3904) has its base electrode connected to the node 314, and has its emitter electrode connected to the ground voltage rail 122. A resistive divider formed by a resistor 320 (having a value of approximately 4.7KΩ) and a resistor 322 (having a value of approximately 22KΩ) connected in series between pin 7 of the current mode control IC 144 and the collector electrode of the transistor 316 via an intermediate node 324. A pnp bipolar transistor 326 (of the type 2N3906) has its base electrode connected to the node 324, and has its emitter electrode connected to pin 7 of the current mode control IC 144. A tapped, variable resistor 328 (having a nominal value of 20KΩ) is connected between the collector electrode of the transistor 326 and the ground voltage rail 122.

The tapped terminal of variable resistor 328 is connected to pin 3 of the current mode control IC 144 via a resistor 330 (having a value of approximately 5.11KΩ), a diode 332 (of the type 1N4148) and a resistor 334 (having a value of approximately 11.3KΩ) connected in series. A resistor 336 (having a value of approximately 14.3KΩ), a diode 338 (of the type 1N4148) and a capacitor 340 (having a value of approximately 1 μF) are connected in series between pin 4 of the current mode control IC 144 and the ground voltage rail 122. The anode electrodes of the diodes 332 and 338 are connected together.

The integrated circuit 144 and its associated components form a voltage-boost circuit which operates at a frequency of nominally 23 KHz and produces, when activated, a boosted output voltage between the output terminals 134 and 136. The detailed operation of such a voltage-boost circuit is described more fully in, for example, U.S. patent application Ser. No. 07/665,830, which is assigned to the same assignee as the present application, and the disclosure of which is hereby incorporated herein by reference.

The transistors 178 and 180, the inductor 196, the capacitor 198 and their associated components form a self-oscillating inverter circuit which produces, when activated, a high-frequency (e.g. 40 KHz) AC voltage across the primary winding 214 of the output-coupling transformer 212. The voltages induced in the secondary windings 218, 220, 222 and 224 216 of the output-coupling transformer serve to heat the lamp filaments 102A & 102B, 104A & 104B and 106A & 106B and the voltage induced in the secondary winding 216 of the output-coupling transformer serves to drive current through the lamps 102, 104 and 106. The detailed operation of such a self-oscillating inverter circuit is described more fully in, for example, U.S. patent application Ser. No. 07/705,856, which is assigned to the same assignee as the present application, and the disclosure of which is hereby incorporated herein by reference.

In operation of the circuit of FIG. 1, with the switches S1 and S2 closed and with a voltage of 277 V, 60 Hz applied across the input terminals 108 and 110, the bridge 112 produces between the node 120 and the ground voltage rail 122 a unipolar, full-wave rectified, DC voltage having a frequency of 120 Hz.

When the circuit is first powered-up, the activation of the voltage-boost IC 144 is controlled, for reasons which will be explained below, by the resistive-capacitive divider 170, 172 connected between the output nodes 118 and 120 of the bridge circuit 112. The component values in the preferred embodiment of the circuit of FIG. 1 are chosen to produce a delay of approximately 0.7 seconds between initial power-up of the circuit and activation of the voltage-boost IC 144. Similarly, when the circuit is first powered-up, the activation of the self-oscillating inverter is controlled by the resistive-capacitive divider 190, 192 connected between the output terminals 134 and 136 of the voltage-boost circuit formed by the IC 144 and its associated components. The component values in the preferred embodiment of the circuit of FIG. 1 are chosen to produce a delay of approximately 40 milliseconds between initial power-up of the circuit and activation of the self-oscillating inverter.

The circuit of FIG. 1 is so arranged that, with the self-oscillating inverter activated but before activation of the voltage-boost IC 144, an unboosted voltage of approximately 390 V appears across the output terminals 134 and 136, and the voltage induced in the secondary windings 118, 120, 122 and 124 is sufficient to produce significant heating of the filaments 102A & 102B, 104A & 104B and 106A & 106B, but the voltage induced in the secondary winding 216 is insufficient to cause the lamps to strike. However, after activation of the voltage-boost IC 144, a boosted voltage of approximately 458 V appears across the output terminals 134 and 136 and the voltage induced in the secondary windings 118, 120, 122 and 124 continues to heat the filaments and the voltage induced in the secondary winding 216 is sufficient to cause the lamps to strike.

Thus, by arranging that (i) the unboosted voltage across the output terminals 134 and 136 causes heating of the filaments 102A & 102B, 104A & 104B and 106A & 106B but no striking Of the lamps 102, 104 and 106, (ii) there is a delay of approximately ⅔ seconds (0.66=0.7–0.04) seconds between activation of the self-oscillating inverter and activation of the voltage-boost circuit; and (iii) the boosted voltage across the output terminals 134 and 136 causes striking of the lamps 102, 104 and 106 as well as continued heating of the filaments 102A & 102B, 104A & 104B and 106A & 106B, the circuit of FIG. 1 simply and effectively produces pre-heating of the lamp filaments before the lamps are caused to strike.

Such differentially delayed inverter/voltage-boost start-up is described in greater detail in U.S. patent application Ser. No. 07/705,865, which is assigned to the same assignee as the present application, and the disclosure of which is hereby incorporated herein by reference.

The control circuit 300 controls dimming operation of the drive circuit 100 in dependence on the operation of the "HIGH-LOW" switch S2 as follows. With the switch S2 in its CLOSED or HIGH position, when the circuit is powered up by closing the switch S1 pulsating D.C. voltage from the node 114 appears at the cathode electrode of the diode 308. This pulsating voltage is filtered by the capacitor 315 and causes the diode 308 to be reverse biased and results in the production of a steady voltage of approximately 5 V across the resistors 302 and 304. In this condition, the transistor 316 will be turned ON, pulling low the node 314 and causing the transistor 318 to be turned OFF. With the transistor 318 turned OFF, the transistor 326 is prevented from turning ON. Thus, in this condition with the transistor 318 turned OFF, no bias is applied through the tap terminal of the variable resistor 328 to pins 3 or 4 of the voltage boost IC 144. The lack of D.C. bias at pins 3 and 4 of the boost IC 144 allows the voltage boost IC to operate in its normal manner at full power.

If the "HIGH-LOW" switch S2 is placed in its OPEN or LOW position while the circuit is operating, the voltage at the cathode electrode of the diode 308 falls from its value of approximately 5 V as the capacitor 315 discharges through the resistor 302. When the voltage across the resistor 304 falls below approximately 0.6 V, the transistor 316 is turned OFF, allowing the node 314 to rise high and causing the transistor 318 to be turned ON. With the transistor 318 turned ON, the node 324 is pulled low and the transistor 326 is turned ON. Thus, in this condition with the transistor 318 turned ON, D.C. bias is applied through the tap terminal of the variable resistor 328 to pins 3 and 4 of the voltage boost IC 144. The D.C. bias at pin 3 (the "CURRENT SENSE" input) of the boost IC 144 causes a reduction in the power that the voltage boost IC produces, causing the lamps 102, 104, 106 to dim to a predetermined LOW light level. As will be explained in greater detail below, at the same time, the D.C. bias at pin 4 (the "FREQUENCY CONTROL" input) of the boost IC 144 causes an increase in the frequency at which the voltage boost IC operates.

When the D.C. bias is applied to pin 3 of the voltage boost IC 144 to limit its power output and so produce dimming of the lamps 102, 104, 106, the power factor of the circuit will otherwise be reduced from its optimum value since the voltage boost IC 144 is being forced to operate at less than its full power level for which its design was optimized. In order to correct for this fall in power factor, the D.C. bias is applied to pin 4 of the voltage boost IC so as to increase the voltage boost IC's frequency of operation commensurate with the reduced power. The effect of increasing the voltage boost IC's frequency of operation commensurate with its reduced power output is to compensate for the associated fall in power factor, thereby retain retaining a substantially constant, optimum power factor for the circuit in both the HIGH power (or full light) and LOW power (or dimmed light) states.

It will be appreciated that the circuit described provides dimming of the lamps without varying the frequency at which the lamps are driven, this frequency remaining substantially constant at approximately 40 KHz as described above. Thus, the circuit provides dimming which is not susceptible to variation of the circuit's operating temperature.

It will also be appreciated that the above circuit allows dimming to be performed efficiently and simply, the control circuit 300 requiring components which are simple and few in number. It will also be appreciated that in the above circuit, dimming can be simply and effectively provided as an add-on or retro-fit feature by adding the additional switch "HIGH-LOW" switch S2 and the control circuit 300: without these additional components the circuit operates as a conventional fixed-light-level ballast circuit.

It will also be understood that although the above circuit has been described as operating in only a HIGH power (or full light) mode and a predetermined LOW power (or dimmed light), the power or light level of the LOW power mode can be varied, e.g., by adjusting the variable resistor 328, to produce any of a desired range of dimmed lighting levels. It will be understood that the power factor of the circuit remains substantially constant throughout variation of the LOW power level in this way, since the D.C. bias applied at pin 4 of the voltage boost IC 144 to increase its frequency of operation is commensurate with the D.C. bias applied at pin 3 to reduce the IC's power output.

It will be appreciated that the component values used in the above described circuit, and the particular voltage levels may be varied as desired to suit different types of fluorescent or other gas discharge lamps as desired.

It will also be appreciated that although the invention has been described above in relation to a power supply for a circuit used to drive lighting units, the invention is not limited to use in connection with lighting units and may be used equally well as a power supply in other applications.

It will be appreciated that various other modifications or alternatives to the above described embodiment will be apparent to a person skilled in the art without departing from the inventive concept.

I claim:

1. A power supply circuit for producing different power levels comprising:

an input coupled to a source of AC power;

a rectifier, having two rectifier input terminals and two rectifier output terminal, the rectifier input terminals coupled to the input;

a first switch coupled between the input and the rectifier;

voltage boost means, coupled to the rectifier output terminals, for producing a boosted voltage, the voltage boost means having a power control input and a frequency control input;

power control means coupled to the power control input of the voltage boost means for controlling, in response to a signal, the current produced by the voltage boost means, and thereby the power produced by the power control means, the power control means having a power control input terminal; and frequency control means coupled to the frequency control input of the voltage boost means for controlling the frequency of operation thereof in dependence on the power produced by the voltage boost means, such that when the power produced by the voltage boost means is decreased the frequency of operation of the voltage boost means is increased, and that when the power produced by the voltage boost means is increased, the frequency of operation of the voltage boost means is decreased, so as to provide power factor correction in dependence on the power produced by the voltage boost means; and a second switch, coupled in series between one rectifier input terminal and the power control input terminal, for generating a signal to the power control means to change the illumination level of the lamp, the power control means coupled to one rectifier output terminal.

2. A power supply circuit according to claim 1 wherein the voltage boost means comprises a current mode control circuit.

3. A power supply circuit according to claim 1 wherein the power control means comprises first D.C. bias means for applying a first D.C. bias to the current control input of the voltage boost means to control the power produced thereby.

4. A power supply circuit according to claim 1 wherein the frequency control means comprises second D.C. bias means for applying a second D.C. bias to the frequency control input of the voltage boost means to control the frequency of operation thereof.

5. A power supply circuit according to claim 1 further comprising D.C. supply means, and wherein the power control means comprises first D.C. bias means for applying a first D.C. bias derived from the D.C. supply means to the current control input of the voltage boost means to control the power produced thereby; and the frequency control means comprises second D.C. bias means for applying a second D.C. bias derived from the D.C. supply means to the frequency control input of the voltage boost means to control the frequency of operation thereof.

6. A circuit for driving a gas discharge lamp load at different illumination levels, the circuit comprising:

an input coupled to a source of AC voltage;

a rectifier having at least one rectifier input terminal and at least one rectifier output terminal, the rectifier input terminal coupled to the input;

voltage boost means coupled to the rectifier output terminal for producing a boosted voltage, the voltage boost means having a power control input and a frequency control input;

power control means coupled to the power control input of the voltage boost means for controlling, in response to a signal, the current produced by the voltage boost means, and thereby the power produced by the voltage boost means, the power control means being coupled to the rectifier output terminal; and frequency control means coupled to the frequency control input of the voltage boost means for controlling the frequency of operation thereof in dependence on the power produced by the voltage boost means, such that when the power produced by the voltage boost means is decreased the frequency of operation of the voltage boost means is increased, and that when the power produced by the voltage boost means is increased, the frequency of operation of the voltage boost means is decreased, so as to provide power factor correction in dependence on the power produced by the voltage boost means;

a switch, coupled to the rectifier input terminal, for generating the signal to the power control means to change the illumination level of the lamps; and oscillator means powered by voltage boost means for producing a output signal to drive the gas discharge lamp load, the frequency of the oscillator means output signal being substantially independent of the frequency of operation of the voltage boost means.

7. A circuit according to claim 6 wherein the voltage boost means comprises a current mode control circuit.

8. A circuit according to claim 6 wherein the power control means comprises first D.C. bias means for applying a first D.C. bias to the current control input of the voltage boost means to control the power produced thereby.

9. A circuit according to claim 6 wherein the frequency control means comprises second D.C. bias means for applying a second D.C. bias to the frequency control input of the voltage boost means to control the frequency of operation thereof.

10. A power supply circuit according to claim 6 further comprising D.C. supply means, and wherein the power control means comprises first D.C. bias means for applying a first D.C. bias derived from the D.C. supply means to the current control input of the voltage boost means to control the power produced thereby; and the frequency control means comprises second D.C. bias means for applying a second D.C. bias derived from the D.C. supply means to the frequency control input of the voltage boost means to control the frequency of operation thereof.

11. A power supply circuit for producing different power levels comprising:

an input coupled to a source of AC power;

a rectifier, having two rectifier input terminals and two rectifier output terminal, the rectifier input terminals coupled to the input;

a first switch coupled between the input and the rectifier;

voltage boost means, coupled to the rectifier output terminals, for producing a boosted voltage, the voltage boost means having a power control input and a frequency control input, the frequency control input and the power control input being separate inputs;

power control means coupled to the power control input of the voltage boost means for controlling, in response to a signal, the current produced by the voltage boost means, and thereby the power produced by the power control means, the power control means having a power control input terminal; and frequency control means coupled to the frequency control input of the voltage boost means for controlling the frequency of operation thereof in dependence on the power produced by the voltage boost means, such that when the power produced by the voltage boost means is decreased the frequency of operation of the voltage boost means is increased, and that when the power produced by the voltage boost means is increased, the frequency of operation of the voltage boost means is decreased, so as to provide power factor correction in dependence on the power produced by the voltage boost means; and a second switch, coupled in series between one rectifier input terminal and the power control input terminal, for generating a signal to the power control means to change the illumination level of the lamp, the power control means coupled to one rectifier output terminal.

12. A power supply circuit according to claim 1 wherein the voltage boost means comprises a current mode control circuit.

13. A power supply circuit according to claim 1 wherein the power control means comprises first D.C. bias means for applying a first D.C. bias to the power control input of the voltage boost means to control the power produced thereby.

14. A power supply circuit according to claim 1 wherein the frequency control means comprises second D.C. bias means for applying a second D.C. bias to the frequency control input of the voltage boost means to control the frequency of operation thereof.

15. A power supply circuit according to claim 1 further comprising D.C. supply means, and wherein the power control means comprises first D.C. bias means for applying a first D.C. bias derived from the D.C. supply means to the power control input of the voltage boost means to control the power produced thereby; and the frequency control means comprises second D.C. bias means for applying a second D.C. bias derived from the D.C. supply means to the frequency control input of the voltage boost means to control the frequency of operation thereof.

* * * * *